US005228372A

United States Patent [19]

Harrop et al.

[11] Patent Number: 5,228,372

[45] Date of Patent: Jul. 20, 1993

[54] CUTTING DEVICE

[75] Inventors: Martin Harrop, Clifton; Francis F. H. Rawson, Queniborough, both of Great Britain

[73] Assignee: Nestec S.A., Vevey, Switzerland

[21] Appl. No.: 778,672

[22] Filed: Oct. 18, 1991

[30] Foreign Application Priority Data

Oct. 19, 1990 [GB] United Kingdom ..... 9022844

[51] Int. Cl.[5] ..... B26D 1/45; B26D 7/08

[52] U.S. Cl. ..... 83/13; 83/701; 83/932

[58] Field of Search ..... 83/13, 701, 932, 620; 51/59 S

[56] References Cited

U.S. PATENT DOCUMENTS 2,813,377 11/1957 Duran ..... 51/59 SS
3,031,804 5/1962 Thatcher et al. ..... 51/59 SS
3,416,398 12/1968 Bodine, Jr. ..... 83/523
3,471,724 10/1969 Balamuth ..... 51/59 SS

FOREIGN PATENT DOCUMENTS

0353415A1 2/1990 European Pat. Off. .

*Primary Examiner*—Hien H. Phan
*Attorney, Agent, or Firm*—Vogt & O'Donnell

[57] ABSTRACT

An ultrasonic cutting device includes an ultrasonic vibrating device and an elongated cutting blade. The ultrasonic vibrating device generates vibrations along a longitudinal axis and includes two or more parallel support members extending in the direction of the longitudinal axis of vibrations. The elongated cutting blade, positioned in a plane transverse to the longitudinal axis of vibrations, is connected at each of its respective ends to adjacent support members, at anti-nodes of the support members.

16 Claims, 1 Drawing Sheet

CUTTING DEVICE

BACKGROUND OF THE INVENTION

The present invention relates to improved ultrasonic cutting devices and methods.

In a prior art ultrasonic cutting device and method, a cutting blade is mounted on an ultrasonic vibrating device in a manner such that the blade lies in a plane containing the longitudinal axis of vibrations generated by the ultrasonic vibrating device. In operation, the blade is vibrated in its plane and is moved through an article to be cut in that plane.

Difficulty is experienced using such cutting devices and methods, in that the depth of cut which is attainable is limited. For this reason, ultrasonic cutting has in general been limited to thin articles, such as paper, cloth and thin plastic sheets. A significant problem exists in cutting blocks of substantial depth, and/or in providing a number of parallel cuts simultaneously. Difficulty is also experienced in cutting materials which are brittle, such as honeycomb or crystalline materials.

In European patent Application 0353415A, the entirety of which is hereby incorporated herein by reference, there is described a method and apparatus for cutting an article wherein a cutting blade is mounted on an ultrasonic vibrating device in a manner such that the blade lies in a plane extending transverse, preferably at right angles, to the longitudinal axis of vibrations generated by the ultrasonic vibrating device. In operation, the vibrated cutting blade moves back and forth, transverse to the plane in which it is passed through the article, thereby effecting a removal of the material of the article along the line of cut. In one embodiment, the ultrasonic vibrating device comprises one or more vibrated support members, each support member supporting a plurality of cutting blades, each blade being secured to a single support member at its centre.

SUMMARY OF THE INVENTION

It has now been found that when a cutting blade is secured to adjacent support members of an ultrasonic vibrating device significantly more cutting power is provided than when the blade is secured to a single support member.

Thus, the ultrasonic cutting device of the present invention comprises an ultrasonic vibrating device which, in operation, generates vibrations in a direction having a longitudinal axis. The vibrating device comprises two or more parallel support members, or horns, each extending and being vibrated in operation in the direction of the longitudinal axis of vibrations. At least one elongated cutting blade is connected to at least two adjacent support members and is positioned in a plane transverse to the longitudinal axis of vibrations.

Advantageously, the cutting blade is secured at each of its respective ends to the adjacent support members. Preferably, the cutting blade secured by the adjacent support members lies in a plane at right angles to the longitudinal axis of vibration.

The support members or horns are thus vibrated by the ultrasonic vibrating device, and each support member may be connected to a plurality of cutting blades, each blade lying, respectively, in one of a plurality of parallel planes. Most desirably, the cutting blades are connected to the support members at anti-nodes of the support members. As used herein, an "anti-node" shall be understood as meaning a point one quarter wavelength from a node, a node being a stationary point where there is no standing vibration. The cutting blade may, however, be connected to the support member at a position about ±5% of one half wavelength from the anti-node, more preferably about 2% and even more preferably about ±1%. At 20 kHz, for example, the cutting blades may be attached to the support members within about 1.5 mm, preferably within about 1 mm, and more preferably within about 0.5 mm from the true anti-node point.

The support members or horns are made of a high fatigue strength material, and may include, for example, aluminum or titanium alloys. The number of support members is only limited by practical considerations. There may be, for instance, up to 20 support members.

One or more of the support members may be secured to the ultrasonic vibrating device through the intermediary of node/anti-node displacement devices, which enable the cutting blades to be staggered on a plurality of parallel support members. The node/anti-node displacement devices may be of reduced mass or added mass, so as to displace an anti-node towards or away from, for example, the front face of a mother horn connected to the support members which vibrates at ultrasonic frequency.

The cutting blades are conveniently made of steel, e.g., graphite impregnated steel or tempered high tensile steel. They may be coated with chrome or polytetrafluoroethylene, which may impart a non-stick surface. The cutting edge of the blade may be spark-eroded or otherwise cut to produce a hollow edge.

The cutting blades may be wide, narrow or thin, or they may be wires. They may be round, triangular or roughly square in shape, but are preferably rectangular, e.g., from about 10 mm to about 100 mm long and from about 1 mm to about 22 mm wide. When the blades are roughly square or rectangular in shape, they are advantageously profiled so that they are narrower along a portion of their lengths than at their ends. For example, from about 40% to about 90% and preferably from about 50% to about 70% of their length between the ends is narrower and the width may be up to about 60% less than at the ends. The thickness of the blades may be from about 0.25 mm to about 1 mm and more usually from about 0.3 mm to about 0.6 mm, especially from about 0.35 mm to about 0.45 mm.

Preferably, the ultrasonic vibrating device comprises a vibrating mechanism or means to which the support member or support members are secured, the vibrating mechanism being in the form of a horn, preferably cylindrical or rectangular in shape, and having a surface which is caused to vibrate at ultrasonic frequency. For example, the horn may be in the form of a cylindrical rod, 22 mm to 60 mm in diameter, and approximately 125 mm long at 20 kHz.

The present invention also comprises a method for cutting a material which comprises generating and transmitting ultrasonic vibrations through and in the longitudinal direction of each of at least two parallel elongated support members which are connected, respectively, at anti-nodes, to an elongated cutting blade positioned in a plane transverse to the longitudinal direction of vibrations, so that the cutting blade is vibrated transversely to the longitudinal axis of vibrations; and then passing the vibrated cutting blade through the material to be cut. The vibrated cutting blade may be passed through the material to be cut by moving the blade through the material, or, alternatively, by moving the material through the blade.

In accordance with the method of the present invention, friable materials, which will shatter if dropped, may be cut without generating amounts of scrap material resulting from prior art cutting methods. Confections, candies and other comestibles may be cut. For example, edible wafers of the type used in chocolate-coated candy bars may be cut. Chocolate, although relatively more malleable, is also disposed to crack, split and splinter when cut, and is advantageously cut with reduced material loss in accordance with the method of the present invention. Other materials which may be cut in accordance with the present invention include cosmetics and pharmaceuticals.

The ultrasonic cutting methods and devices of the present invention are illustrated in the accompanying drawings.

DETAILED DESCRIPTION OF THE DRAWINGS

Figure 1:
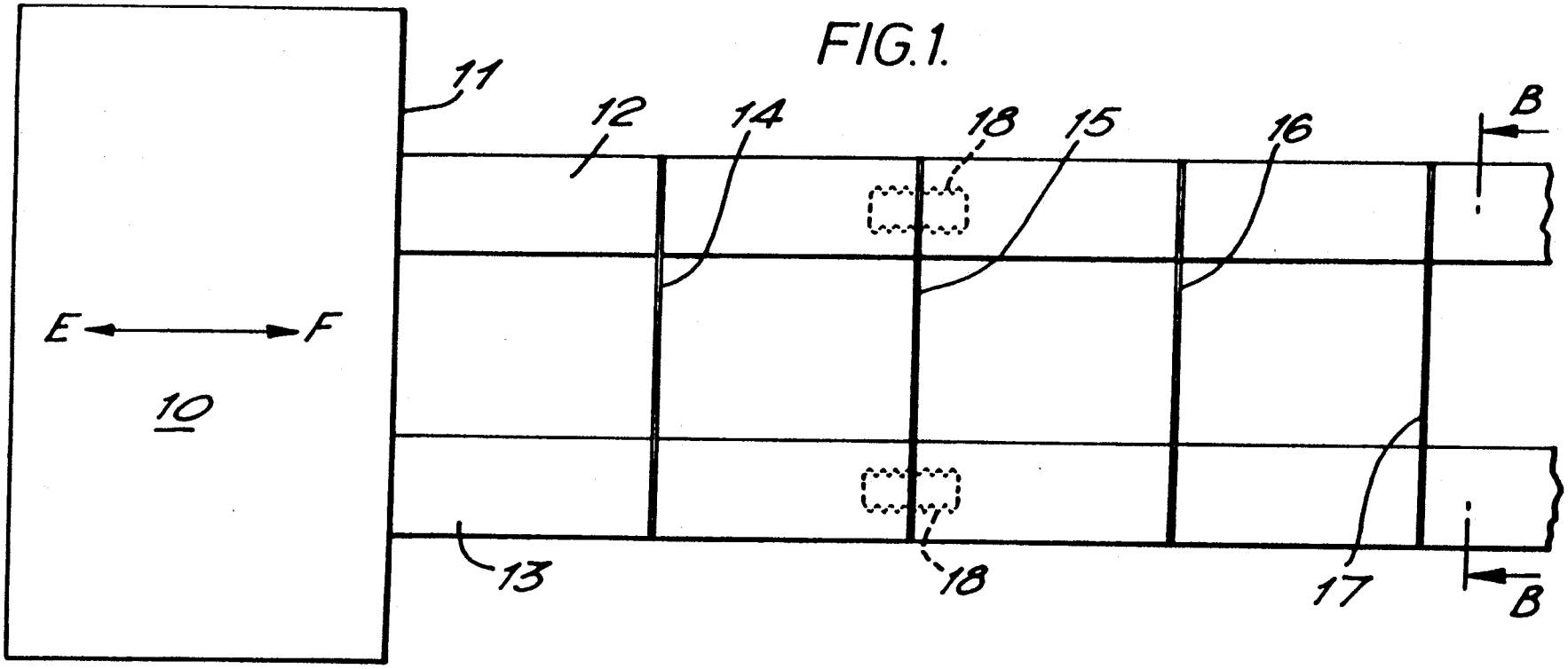
FIG. 1 is a diagrammatic side sectional view of an ultrasonic cutting device according to the invention.
Figure 2:
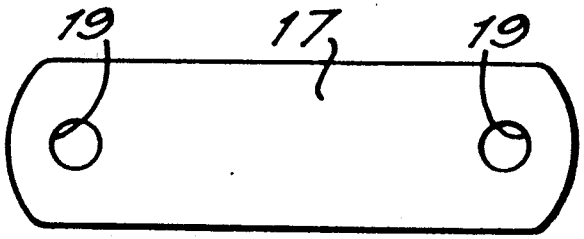
FIG. 2 is a view of a cutting blade shown in FIG. 1, looking in the direction of the arrows B—B.
Figure 3:
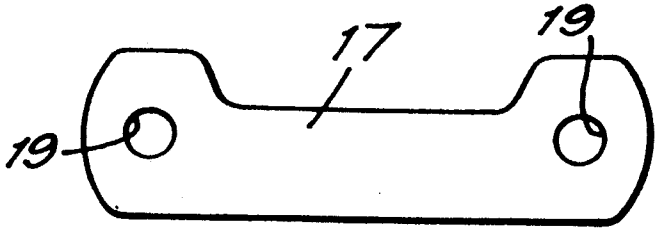
FIG. 3 illustrates an alternative shape of a cutting blade for use in the ultrasonic cutting device of the present invention.

FIG. 1 shows a preferred embodiment of the ultrasonic cutting device of the present invention which comprises a vibrating device 10 in the form of a cylindrical or rectangular shaped mother horn, the front face 11 of which is vibrated at ultrasonic frequency in the longitudinal direction E-F, the face 11 representing an anti-node of the device. Connected to the front face 11 are two or more pairs of parallel support members 12 and 13 extending in the longitudinal direction E-F.

Mounted at spaced intervals between the support members 12 and 13 are elongated cutting blades 14, 15, 16 and 17. Each blade is connected at opposite ends to a support member by an internal stud fastening 18 which passes through the apertures 19. The cutting blades are 0.38 mm thick, 15 mm wide and 90 mm long.

The cutting blades are positioned in planes extending at right angles to the longitudinal axes of the support members, and are located on the support members at spaced anti-nodes thereof. Thus, in use or operation, the cutting blades are vibrated in a complicated mode, primarily in the direction E-F, and on passage through the article to be cut, will excavate a cut from the article, as the blade passes through the article.

When the vibrated cutting blade is moved relative to the article to be cut, relative movement taking place in a direction at right angles to the longitudinal axis E-F, with the blades moving in the planes in which they lie, the article may be cut simultaneously by a plurality of cut lines.

We claim:

1. A method for cutting a material which comprises:

transmitting ultrasonic vibrations through and in the longitudinal direction of each of at least two parallel elongated support members which are connected, respectively, at anti-nodes, to a plurality of cutting blades positioned in spaced parallel planes transverse to the longitudinal direction of vibrations, so that the cutting blades are vibrated transversely to the longitudinal axis of vibrations; and passing the vibrated cutting blades through the material to be cut.

2. A method according to claim 1 wherein the vibrated cutting blades are passed through the material by moving the blades through the material.

3. A method according to claim 1 wherein the vibrated blades are passed through the material by moving the material through the blades.

4. A method according to claim 1 wherein the material which is cut is a chocolate material.

5. A method according to claim 1 wherein the material which is cut is an edible wafer.

6. An ultrasonic cutting device comprising:

an ultrasonic vibrating device which, in operation, generates ultrasonic vibrations in a direction having a longitudinal axis, the ultrasonic vibrating device comprising at least two parallel support members extending and being vibrated, in operation, in the direction of the longitudinal axis of vibrations; and a plurality of elongated cutting blades connected to at least two adjacent support members, the cutting blades being positioned in spaced parallel planes transverse to the longitudinal axis of vibrations and being connected to the support members at anti-nodes of the support members.

7. An ultrasonic cutting device according to claim 1 wherein each cutting blade is connected at each of its respective ends to adjacent support members.

8. An ultrasonic cutting device according to claim 1 wherein each cutting blade is positioned in a plane at right angles to the longitudinal axis of vibrations.

9. An ultrasonic cutting device according to claim 1 wherein the cutting blades are rectangular in shape and have a length of from about 10 mm to about 100 mm and a width of from about 1 mm to about 22 mm.

10. An ultrasonic device according to claim 9 wherein the cutting blades are narrower along a portion of their lengths than at their ends.

11. A cutting device according to claim 10 wherein the cutting blades have a thickness of from about 0.25 mm to about 1 mm.

12. A cutting device according to claim 1 wherein the support members are secured to the vibrating device through the intermediary of node/anti-node displacement devices.

13. A cutting device according to claim 1 wherein the ultrasonic vibrating device comprises a vibrating means to which the support members are secured, the vibrating means being in the form of a horn, one surface of which is vibrated in operation at ultrasonic frequency in the direction of the longitudinal axis of vibrations.

14. An ultrasonic cutting device comprising:

an ultrasonic vibrating device which, in operation, generates ultrasonic vibrations in a direction having a longitudinal axis, the ultrasonic vibrating device comprising at least two parallel support members extending and being vibrated, in operation, in the direction of the longitudinal axis of vibrations; and a plurality of elongated cutting blades connected to at least two adjacent support members, the cutting blades being positioned in spaced parallel planes transverse to the longitudinal axis of vibrations and being connected to the support members at a position about ±5% of one half wavelength from an anti-node of the support members.

15. An ultrasonic cutting device according to claim 14 wherein each cutting blade is connected to the support members at a position about ±2% of one half wavelength from an anti-node of the support members.

16. An ultrasonic cutting device according to claim 15 wherein each cutting blade is connected to the support members at a position about ±1% of one half wavelength from an anti-node of the support members.

* * * * *

UNITED STATES PATENT AND TRADEMARK OFFICE

CERTIFICATE OF CORRECTION

PATENT NO. : 5,228,372

DATED : July 20, 1993

INVENTOR(S) : Martin HARROP, et al.

It is certified that error appears in the above-identified patent and that said Letters Patent is hereby corrected as shown below:

Column 4, line 29 [line 1 of claim 7], "1" should be --6--.

Column 4, line 32 [line 1 of claim 8], "1" should be --6--.

Column 4, line 35 [line 1 of claim 9], "1" should be --6--.

Column 4, line 45 [line 1 of claim 12], "1" should be --6--.

Column 4, line 49 [line 1 of claim 13], "1" should be --6--.

Signed and Sealed this

Fifteenth Day of March, 1994

*Attest:*

Bruce Lehman

BRUCE LEHMAN

*Attesting Officer*

*Commissioner of Patents and Trademarks*